US006016672A

United States Patent [19]

Kim et al.

[11] Patent Number: 6,016,672

[45] Date of Patent: Jan. 25, 2000

[54] WASHING MACHINE HAVING A WATER GUIDE FOR FORMING VERTICAL AND HORIZONTAL CURRENTS OF WASH WATER

[75] Inventors: Young-chul Kim; Byung-don Jung, both of Suwon, Rep. of Korea

[73] Assignee: Samsung Electronics Co., Ltd., Suwon, Rep. of Korea

[21] Appl. No.: 09/129,218

[22] Filed: Aug. 5, 1998

[30] Foreign Application Priority Data

| | | | |
|---|---|---|---|
| Jan. 31, 1998 | [KR] | Rep. of Korea | 98-2706 |
| Jan. 31, 1998 | [KR] | Rep. of Korea | 98-2707 |
| Jan. 31, 1998 | [KR] | Rep. of Korea | 98-2708 |
| Jan. 31, 1998 | [KR] | Rep. of Korea | 98-2709 |

[51] Int. Cl.[7] ..... D06F 17/00

[52] U.S. Cl. ..... 68/53

[58] Field of Search ..... 68/18 F, 53

[56] References Cited

U.S. PATENT DOCUMENTS

| | | | |
|---|---|---|---|
| 5,509,283 | 4/1996 | Lee et al. | 68/53 X |
| 5,617,747 | 4/1997 | Kim | 68/53 |
| 5,661,989 | 9/1997 | Jeon et al. | 68/18 F |
| 5,863,423 | 1/1999 | Shin et al. | 68/18 F X |

FOREIGN PATENT DOCUMENTS

| | | |
|---|---|---|
| 56-120181 | 2/1955 | Japan . |
| 2619233 | 3/1997 | Japan . |
| 2695120 | 9/1997 | Japan . |

*Primary Examiner*—Philip R. Coe
*Attorney, Agent, or Firm*—Burns, Doane, Swecker & Mathis, L.L.P.

[57] ABSTRACT

Disclosed is a washing machine having a water guide for forming a vertical and a horizontal flow of wash water. The washing machine comprises a washing and dehydrating tub for receiving the wash water; a pulsator for forming a rotational water flow within the washing and dehydrating tub; and a water guide provided to an inner peripheral surface of the washing and dehydrating tub for defining a vertical passageway along the washing and dehydrating tub. While the wash water is rotated by the rotational movement of the pulsator, some of the water is guided along the passageway to the upper side of the washing and dehydrating tub where the wash water falls to the inner portion of the washing and dehydrating tub. The water guide has a main passageway and a pair of auxiliary passageways. A upper discharge port is formed at the upper portion of the main passageway, and the wash water is discharged through the upper discharge port. The auxiliary passageways have middle discharge ports for forming the side water stream. Thus, the wash water flows in to the inflow section of the water guide and then flows through the passageway upward. Some of the upwardly flowing wash water is discharged through the upper discharge port, while the other horizontally flows out from the middle discharge ports. Accordingly, during a washing/rinsing process, there are two streams of wash water, i.e., the vertically falling wash water which falls from the upper discharge port, and the horizontally flowing wash water which flows out from the middle discharge ports. The side water stream pushes the clothes to be washed to the center of the washing and dehydrating tub, while beating the clothes. Accordingly, the clothes to be washed are beaten by the vertical water stream and the horizontal water stream so that the washing/rinsing performance of the washing machine is much enhanced.

16 Claims, 8 Drawing Sheets

WASHING MACHINE HAVING A WATER GUIDE FOR FORMING VERTICAL AND HORIZONTAL CURRENTS OF WASH WATER

BACKGROUND OF THE INVENTION

1. Field of the Invention

The present invention relates to a washing machine, and more particularly to a washing machine having a water guide forming vertically and horizontally flowing wash water so as to improve the washing efficiency.

2. Description of the Prior Art

Generally, as shown in FIG. 1, a washing machine performing a washing and dehydrating processes comprises a tub 20 installed within a body 10, a washing and dehydrating tub (hereinafter referred to as washing tub; 30) installed within the tub 10 and receives the wash water, a pulsator 40 installed at a bottom surface of the washing tub 30, a driving section 50 installed at a lower portion of the tub 20, and a clutch assembly 60 for selectively transmitting the driving force from the driving section 50 to the pulsator 40 and the washing tub 30.

The washing tub 30 performs a washing and a dehydrating processes, and has a balancer 31 at a upper side thereof. Also, the pulsator 40 has a plurality of blades 41 which are radially formed at the lower portion thereof.

The washing tub 30 has at least one water guide 70 along the inner peripheral surface thereof. As shown in FIG. 2, the water guide 70 defines a vertical passageway within the inner peripheral surface of the washing tub 30. The water guide 70 has a guide member 71 which defines the vertical passageway between the inner peripheral surface of the washing tub 30, and a duct member 72 for supporting the guide member 71 with respect to the washing tub 30. A discharge port 73 is defined at a upper side of the water guide 70, while an inflow port 74 is defined at a lower side thereof. The wash water of the washing tub 30 flows in through the inflow port 74 so as to flow through the water guide 70, and then discharged through the discharge port 73. The discharge port 73 of the water guide 70 is installed with a net 75 for filtering out foreign matters mixed with wash water. Also, the washing tub 30 is defined with a plurality of holes at a side thereof. The tub 20 and the washing tub 30 are interconnected with each other by the holes.

During a washing/rinsing process, the driving force from the driving section 50 is transmitted to the pulsator via the clutch assembly 60. Accordingly, the pulsator rotates so as to form a rotational water stream in the washing tub 30. The pulsator 40 is alternately rotated in opposite directions by the driving section 50. Thus, by the rotational water stream, the washing process is carried out.

During the rotation of the pulsator 40, the blades 41 pushes the wash water into the water guide 70. Thus, the wash water flows into the water guide 70 continuously flows therethrough to the upper portion of the washing tub 30 so as to finally flow out through the discharge port 73 installed at the upper portion of the washing tub 30. At this situation, the foreign matters mixed with the wash water are filtered out by the net 75, and the wash water falls to the bottom of the washing tub 30.

As described, the clothes are washed by the rotational water stream, and by the stream of water circulates through the water guide 70. More specifically, the wash water falling from the discharge port 73 of the water guide 70 beats the clothes in the washing tub 30 so as to improve the washing/rinsing performance. Also, the wash water discharged from the water guide 70 submerges the clothes which was floated by the rotational water stream downward into the wash water of the washing tub 30.

During a dehydrating process, the driving force from the driving section 50 is transmitted to the pulsator 40 and the washing tub 30 via the clutch assembly 60, so that the washing tub 30 and the pulsator 40 simultaneously rotates at a high velocity. The dehydrating process is carried out by the centrifugal force generated therefrom.

However, the conventional washing machine has a drawback that the wash water is discharged only through the discharge portion 73 of the water guide 70, which causes the performance deteriorating of the washing machine.

More specifically, since the rotational water stream is generated by the pulsator 40 during the washing/rinsing process, the clothes tend to attached around the inner peripheral surface of the washing tub 30 because the clothes are affected by the centrifugal force. Even worse, the wash water from the discharge port 73 of the water guide 70 falls directly down to the center portion of the washing tub. Accordingly, the wash water may not affect the clothes to be washed which are attached around the inner peripheral surface of the washing tub 30, and it brings deteriorated washing performance of the washing machine.

SUMMARY OF THE INVENTION

An object of the present invention is to provide a washing machine having a water guide for forming both of a falling stream of wash water and a side water stream so as to beat the clothes to be washed in a washing tub and improve the washing performance.

In order to accomplish above-mentioned object, the washing machine for forming a falling stream of wash water and a side water stream according to the present invention comprises: a body; a tub installed withing the body; a washing tub installed within the tub and receives the wash water; a pulsator installed at a bottom of the washing tub and alternately rotated in opposite directions so as to form a rotational water stream within the washing tub; and at least one water guide provided to an inner peripheral surface of the washing tub forming a vertical passageway along the washing tub. Through a passageway defined between the washing tub and the water guide, some of the wash water flows to a upper portion of the washing tub so as to be discharged thus falls to an inner portion of the washing tub. The water guide simultaneously forms a falling stream of the wash water falling from the upper portion of the washing tub and a side water stream flowing out from a side of the washing tub.

The water guide comprises a guide member incorporating with the inner peripheral surface of the washing tub so as to define the passageway; a duct member installed at a rear portion of the guide member and divides the passageway into a main passageway and a pair of auxiliary passageway; a discharge port through which the wash water guided upward through the main passage of the water guide falls down to the washing tub; and middle discharge ports through which some amount of the wash water guide upward is discharged so as to horizontally flow out to the inner portion of the washing tub. The middle discharge ports are spaced from each other by a predetermined distance along the auxiliary passageways defined by the duct member.

Preferably, the upper discharge port has an oblong shape, while the middle discharge ports have small holes of various sizes . In addition, the number and positions of the holes correspond to the wash water level of the washing tub.

The discharge ports may be arranged in a pair of rows along the main passageway. Alternatively, the discharge ports may be arranged in a pair of rows along the auxiliary passageways.

Accordingly, during the washing/rinsing process, the wash water falls from the upper discharge port and simultaneously flows out from the middle discharge ports. The side water stream, i.e., the wash water flows out from the middle discharge holes of the washing tub pushes the clothes to be washed toward the center of the washing tub. Since the clothes are pushed backward from the inner peripheral surface of the washing tub by the side water stream which is discharged from the middle discharge holes of the washing tub, the falling wash water from the upper discharge port directly beats the clothes so as to improve the washing performance.

BRIEF DESCRIPTION OF THE DRAWINGS

Above object and advantage will be more apparent by describing the present invention with reference to the reference drawing accompanied, in which.

DETAILED DESCRIPTION OF THE PREFERRED EMBODIMENT

Figure 1:
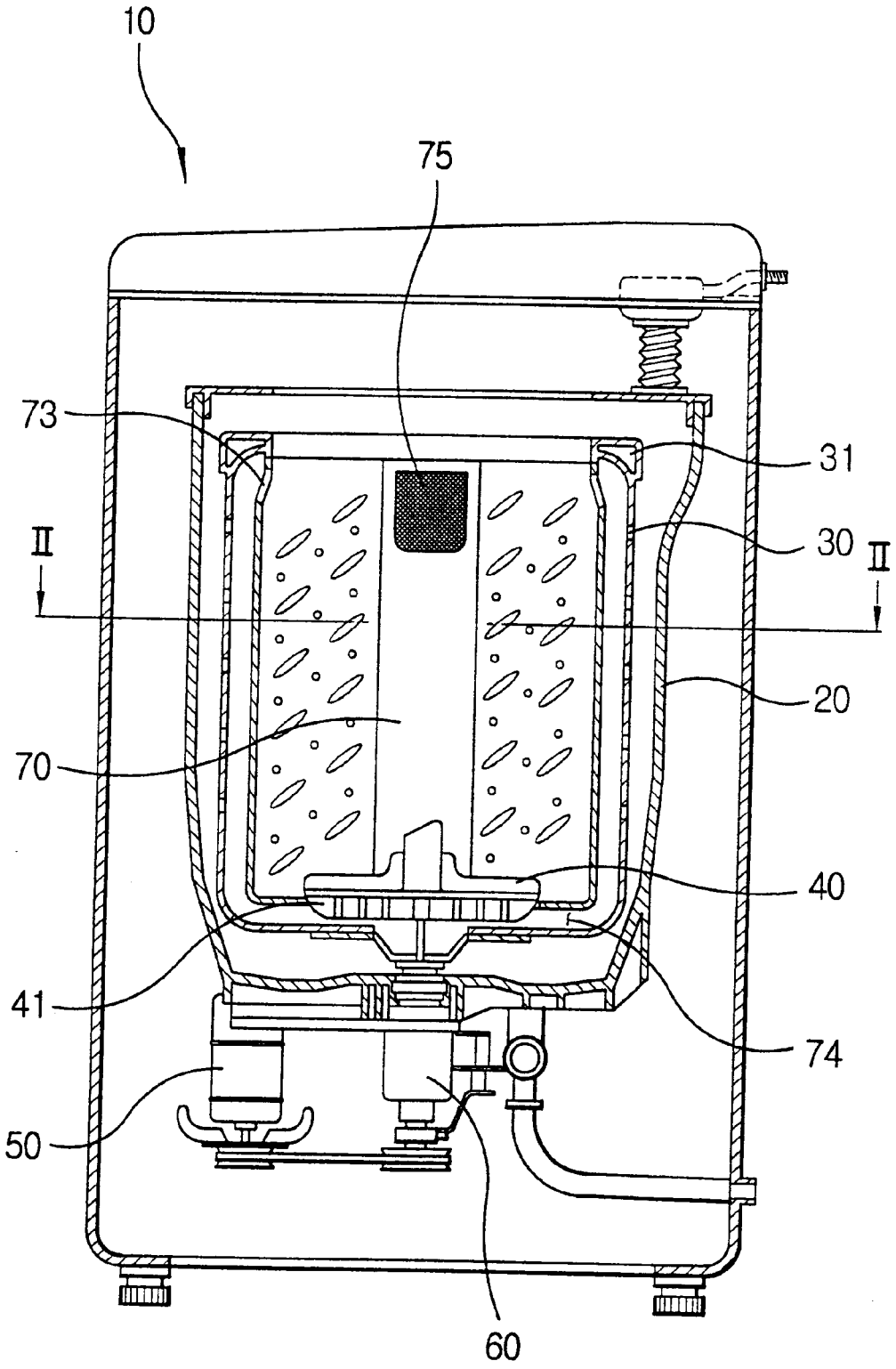
FIG. 1 (PRIOR ART)
FIG. 1 is a cross sectional view showing a washing machine having a conventional water guide.
Figure 2:
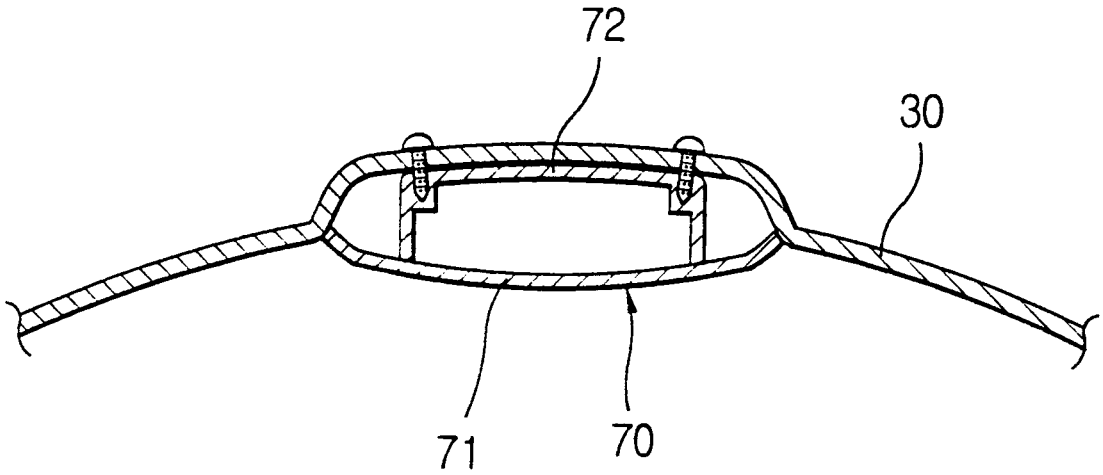
FIG. 2 (PRIOR ART)
FIG. 2 is a cross sectional view of a conventional water guide taken along the line II—II of FIG. 1.
Figure 3:
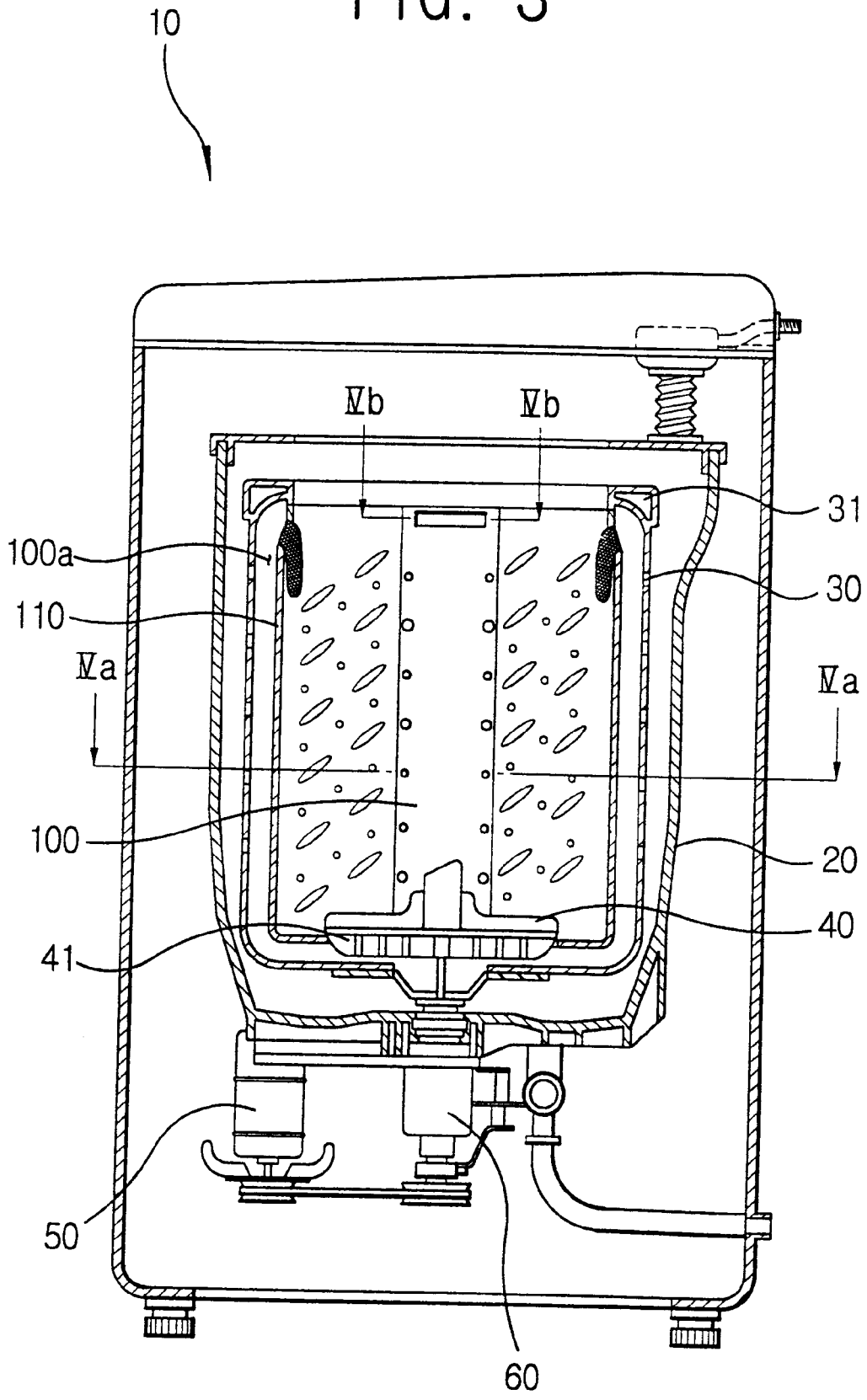
FIG. 3 is a cross sectional view showing a washing machine according to a first embodiment of the present invention.

FIG. 3 shows a washing machine according to the first preferred embodiment of the present invention. Through the description of the preferred embodiments of the present invention, the elements similar with those of the related art will be given the same reference numerals.

As shown in FIG. 3, a main tub 20 is installed within a body 10, and a washing tub 30 is installed within the tub 20. A balancer 31 is installed at a upper side of the washing tub 30, while a pulsator 40 having blades 41 is installed at a lower portion thereof.

Additionally, at a lower portion of the tub 20, a driving section 50, and a clutch assembly 60 for selectively transmitting the driving force from the driving section 50 to the washing tub 30 and the pulsator are installed.

A plurality of water guides 100 are spaced each other by a predetermined interval along the inner peripheral surface of the washing tub 30. Though the preferred embodiment of the present invention depicts four water guides (It will be easily understood that one of the same is hidden in the drawing.), the number of water guide is not limited.

Figure 4A:
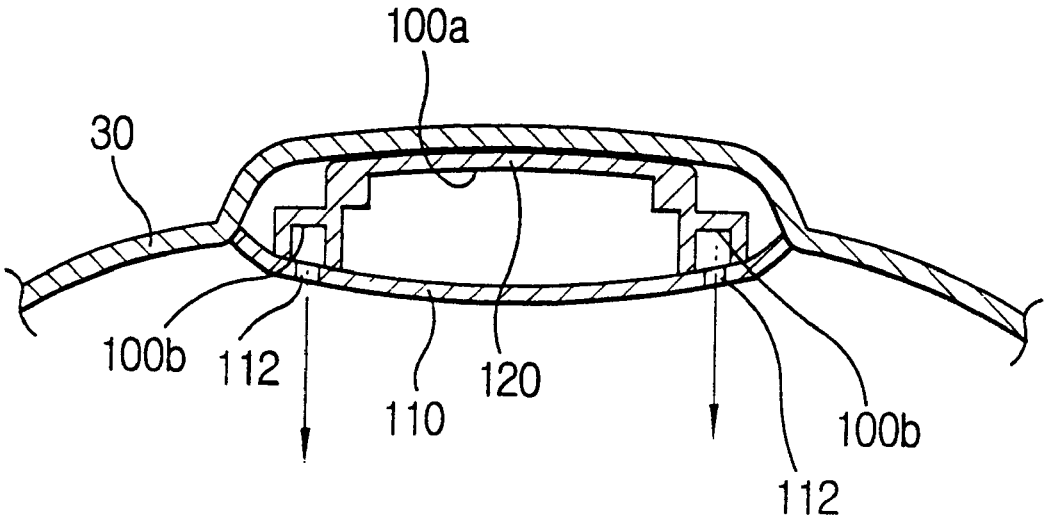
FIGS. 4A and 4B are cross sectional views showing a water guide according to the first preferred embodiment of the present invention, respectively taken along the lines IVA—IVA and IVB—IVB.
Figure 4B:
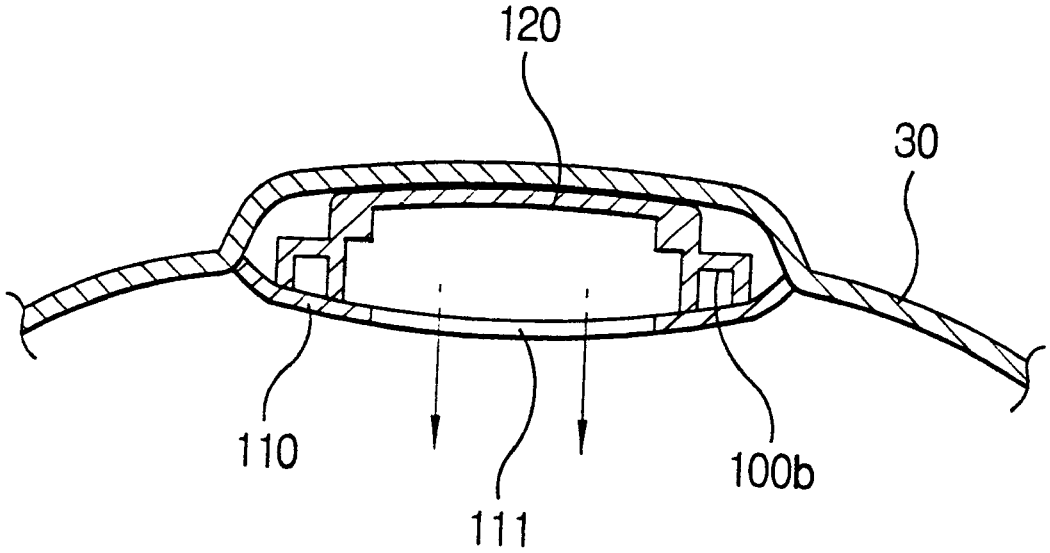

As shown in FIGS. 4A and 4B, the water guide 100 has a guide member 110 and a duct member 120. There are defined a main passageway 100*a* and a pair of auxiliary passageways 100*b* between the guide member 110 and the duct member 120. Respective passageways 100*b* are vertically formed along the washing tub 30.

Additionally, the guide member 110 has a upper discharge port 111 interconnected with the main passageway 100*a*, and a middle discharge port 112 interconnected with the pair of auxiliary passageways 100*b*. The upper discharge port 111 is defined adjacent on upper end of the guide member 100. The middle discharge ports 112 are arranged in a pair of rows along the auxiliary passageways 100*b*. The middle discharge ports 112 are small holes. The diameters of the discharges ports 112 vary in accordance with the position they are formed.

The operation of the washing machine according to the first preferred embodiment of the present invention is described as follows.

During a washing/rinsing process, the driving force from the driving section 50 is transmitted to the pulsator 40 via clutch assembly 60, and accordingly, the pulsator 40 is alternately rotated in opposite directions so as to form a rotational water stream. By the rotational water stream generated as above, the clothes received in the washing tub 30 are washed.

While the wash water rotates by the rotational movement of the pulsator 40, some of the water is diverted a guided to the upper side of the washing tub 30 through the main passageway 100*a* and a pair of auxiliary passageways 100*b* of the water guide 100. The wash water guided along the main passageway 100*a* and auxiliary passageways 100*b* now falls to the washing tub 30 via the upper discharge port 111 formed at the upper side of the washing tub 30. Simultaneously with this, some of the wash water guided along the auxiliary passageways 100*b* flows out from the middle discharge ports 112 of the washing tub 30 in a horizontal direction.

Thus, the wash water falling from the upper discharge port 111 directly falls onto the clothes which are raised by the water stream so as to beat the clothes. Simultaneously, the wash water flowing out from the middle discharge ports 112 pushes the clothes toward the center of the washing tub 30. A side water stream from the middle discharge ports 112 also functions to beat the clothes to be washed while it pushes the clothes toward the center of the washing tub 30.

As the clothes are pushed backward to the center of the washing tub 30 by the side water from the middle discharge ports 112, the falling wash water from the upper discharge port 111 again beats the clothes.

According to the first preferred embodiment of the present invention, the clothes to be washed are prevented from gathering toward the inner peripheral surface of the washing tub 30 which is often cause by the rotational movement of the pulsator 40. Thus, the wash water falling from the upper discharge port 111 of the water guide 100 as well as the wash water horizontally flowing out from the middle discharge ports 112 of the water guide 100 beat the clothes so that the washing performance of the washing machine is much improved.

Figure 5:
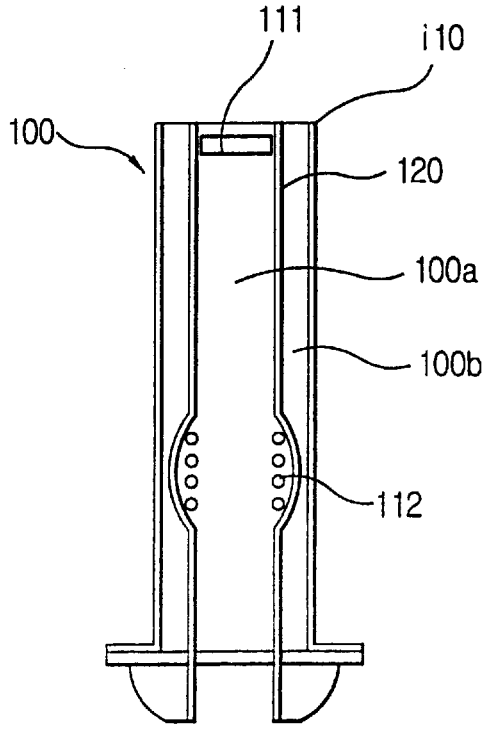
FIG. 5 is a rear elevation showing a water guide according to the second preferred embodiment of the present invention.
Figure 6:
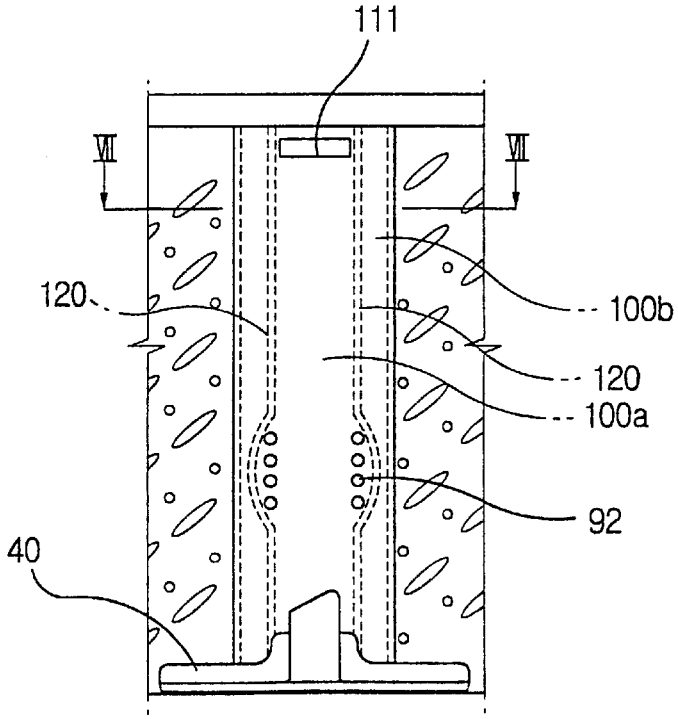
FIG. 6 is an elevation view showing a washing machine employed with a water guide of FIG. 5.

Meanwhile, FIGS. 5 and 6 show a washing machine according to the second embodiment of the present invention. FIG. 5 is a rear elevation view showing a water guide 100 according to the second embodiment of the present invention. FIG. 6 is an elevation view showing certain portion of the washing machine employed with the water guide 100 of FIG. 5.

The washing machine according to the second preferred embodiment of the present invention is constructed in a similar manner with that of the first preferred embodiment. Thus, additional description thereof will be omitted. Hereinafter, the unique element of the second preferred embodiment, i.e., the water guide 100 will be described in greater detail.

The water guide 100 of the washing machine according to the second preferred embodiment of the present invention has the guide member 110 and the duct member 120.

Figure 7A:
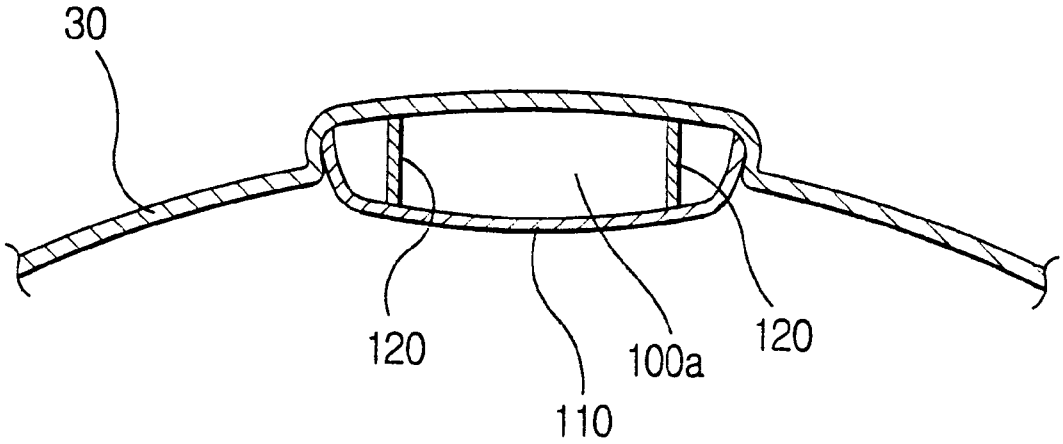
FIG. 7A is a cross sectional view showing a duct member of the water guide according to the second preferred embodiment of the present invention, taken along the line VII—VII of FIG. 6.
Figure 7B:
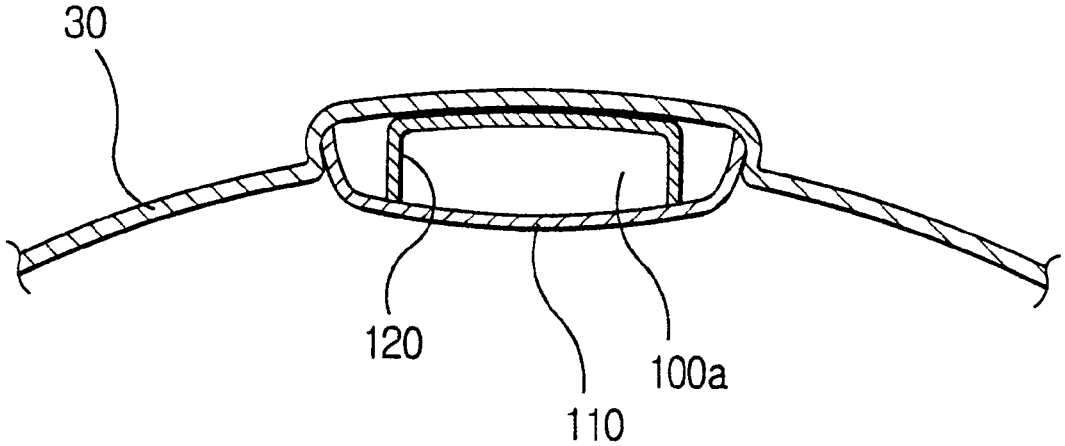
FIG. 7B is a cross sectional view showing another example of duct member of the water guide according to the second preferred embodiment of the present invention, taken along the line VII—VII of FIG. 6.

The duct member 120 is attached to the rear surface of the guide member 110, thereby defines the passageway 100*a*. As shown in FIG. 7A, the duct member 120 is a pair of members extended from the rear surface of the guide member 110 toward the inner peripheral surface of the washing tub 30 so as to define the passageway 100*a*. Alternatively, as shown in FIG. 7B, the duct member 120 may have 'U' shape when the same is viewed from sectional view so as to define the passageway 100*a* directly between the duct member 120 and the guide member 110.

The guide member 110 has a upper discharge port 111 at a upper portion thereof. Also, a plurality of middle discharge ports 112 are vertically arranged in a pair of rows along the guide member 110. It is preferable that the number and positions of the middle discharge ports 112 correspond to the wash water level of the washing tub 30.

The upper discharge ports 111 and middle discharge ports 112 are interconnected with the passageway 100*a*. Also, both certain portions of the duct member 120 corresponding to the middle discharge ports 112 are curved outwardly. Such curved portions of the duct member 120 allow more wash water to gather around the middle discharge ports 112 and to be discharged through the middle discharge ports 112.

In the water guide constructed as above, during the washing/rinsing process and while the wash water is rotated by the rotational movement of the pulsator 40, some of the wash water is guided along the passageway 100*a* of the water guide 100 so as to fall from the upper discharge port 111 and flow out from the middle discharge ports 112 to the washing tub 30.

The operation and the effect thereof are already described early in the description of the first preferred embodiment of the present invention, thus, additional description would be omitted.

Figure 8:
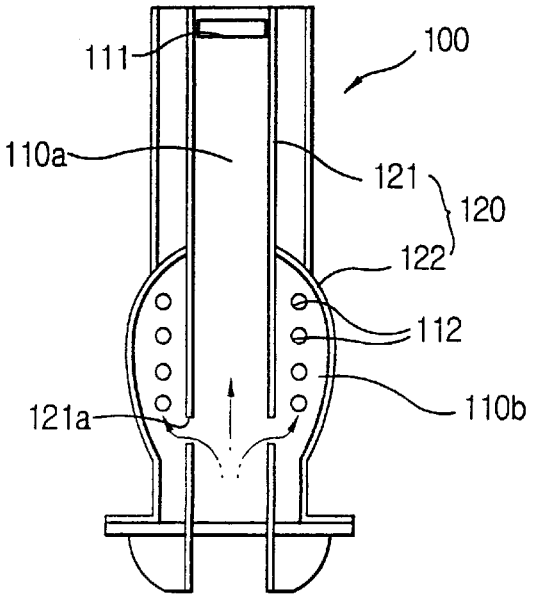
FIG. 8 is a rear elevation view showing a water guide according to the third preferred embodiment of the present invention.
Figure 9:
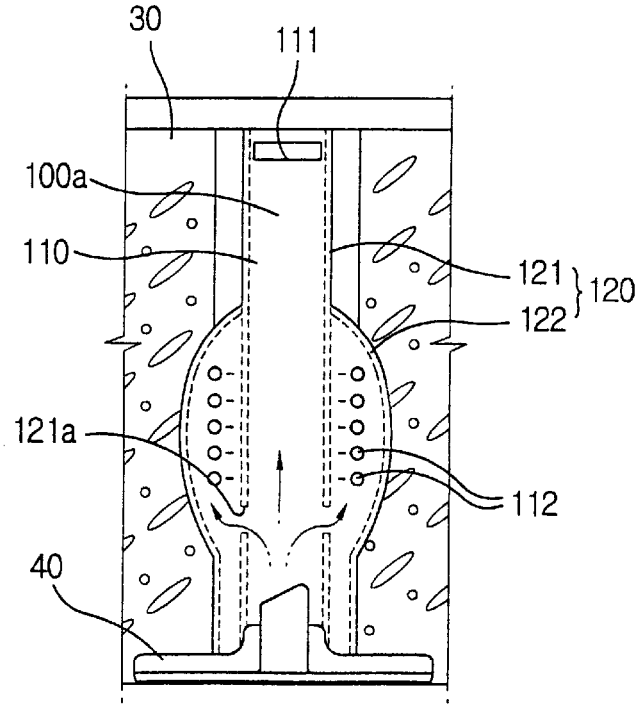
FIG. 9 is an elevation view showing a washing machine employed with the water guide of FIG. 8.

FIGS. 8 and 9 show a washing machine according to the third preferred embodiment of the present invention. Again, the washing machine according to the third preferred embodiment is constructed in a similar manner with that of the first and second preferred embodiments of the present invention. Thus, the description would directly move on to the water guide, which is the unique aspect of the third preferred embodiment of the present invention.

According to the third preferred embodiment of the present invention, the water guide 100 has a guide member 100 and the duct member 120.

The duct member 120 is attached to the rear surface of the guide member 110 so as to define the passageway therebetween. The duct member 120 includes first duct members 121 extended from two rear sides of the guide member 110 to the inner peripheral surface of the washing tub 30 in parallel so as to define the main passageway 100*a* therebetween, and second duct members 122 formed at the rear surface of the lower portion of the guide member 110. The second duct members 122 are curved outwardly and define the auxiliary passageways 110*b*. The first duct members 121 define a wall structure having openings or branch passageways 121*a* possibly at the middle and lower portion thereof. By means of the branch passageways 121*a*, the main passageway 100*a* and the auxiliary passageways 110*b* are interconnected.

Alternatively, as described in the description of the second embodiment of the present invention with respect to FIG. 7B, the duct member 120 may have 'U' shape when the same is viewed from sectional view.

The guide member 110 has the upper discharge port 111 and a plurality of middle discharge ports 112. The upper discharge port 111 is formed at the upper and middle portion of the guide member 110, while the middle discharge ports 112 are vertically arranged in a pair of rows along the guide member 110. The middle discharge ports 112 are interconnected with the auxiliary passageways 100*b*. It is preferable that the number and positions of the middle discharge ports 112 correspond to the wash water lever of the washing tub 30.

Thus, while the wash water is rotated by the rotational movement of the pulsator 40, some of the water is guided along the main passageway 100*a* of the water guide 100 and to the upper side of the washing tub 30 where the water finally falls from the upper discharge port 111 to the center of the washing tub 30. Simultaneously, some of the water guided along the main passageway 100*a* flows in to the auxiliary passageways 100*b* through the branch passageway 121*a* of the first duct member 121 so as to horizontally flow out to the washing tub 30 from the middle discharge ports 112.

Additional description of the operation and effect thereof would be omitted, since it has been already described early.

Figure 10:
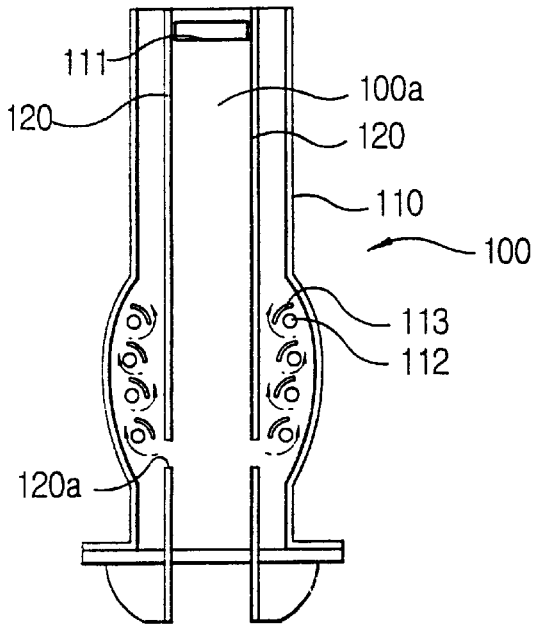
FIG. 10 is a rear elevation view showing a water guide according to the fourth preferred embodiment of the present invention.
Figure 11:
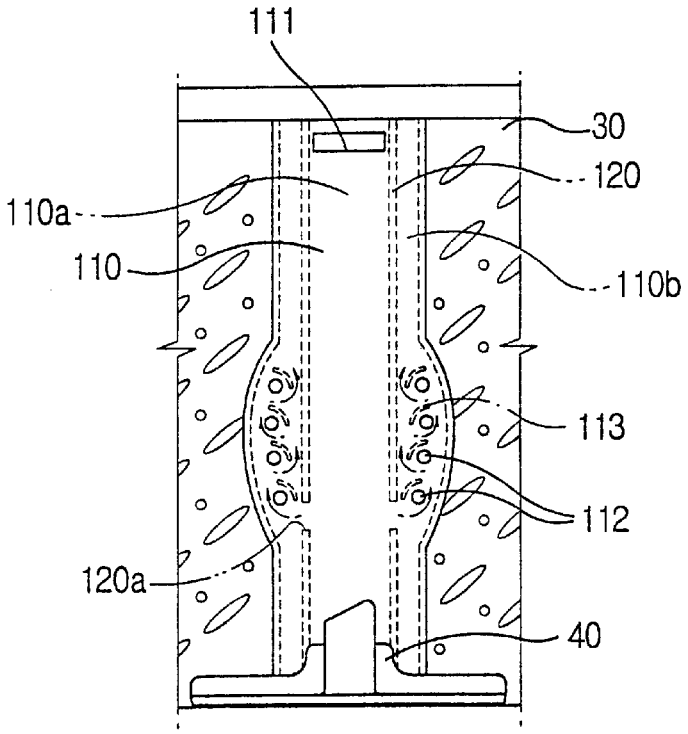
FIG. 11 is an elevation view showing a washing machine employed with the water guide of FIG. 10.

FIGS. 10 and 11 show a washing machine according to the fourth preferred embodiment of the present invention. Again, the washing machine according to the fourth preferred embodiment is constructed in a similar manner with that of the first, second, and third preferred embodiments of the present invention.

According to the fourth preferred embodiment of the present invention, the water guide 100 has the guide member 110 and the duct member 120.

The duct member 120 is attached to the rear surface of the guide member 110 so as to define the passageway therebetween. The duct member 110 includes a pair of members extended from two rear sides of the guide member 110 to the inner peripheral surface of the washing tub 30 in parallel. Accordingly, the main passageway 100*a* is defined between the duct members. Also, the auxiliary passageways 100*b* are defined between the respective duct members 120 and the guide member 110. The first duct members 121 define a wall having branch passageways, i.e., opening or spaces, 121*a* possibly at the middle and lower portion thereof. By means of the branch passageways 121*a*, the main passageway 100*a* and the auxiliary passageways 110*b* are interconnected.

Alternatively, as described in the description of the second embodiment of the present invention with respect to FIG. 7B, the duct member 120 may have 'U' shape when the same is viewed from sectional view.

The guide member 110 has the upper discharge port 111 and a plurality of middle discharge ports 112. The upper discharge port 111 is formed at the upper and middle portion of the guide member 110, while the middle discharge ports 112 are vertically arranged in a pair of rows along the guide member 110. The middle discharge ports 112 are interconnected with the auxiliary passageways 100*b*. It is preferable that the number and positions of the middle discharge ports 112 correspond to the wash water level of the washing tub 30. Respectively above the middle discharge ports 112, the flow guide protrusions 113 in the arc shape are formed. The guide protrusions 113 guide the wash water guided upward along the auxiliary passageways 100*b* so that the wash water flows through the middle discharge ports 112 more smoothly.

Also, both certain portions of the duct members 120 are curved outwardly. Such curved portions of the duct member 120 allow more wash water to gather around the middle discharge ports 112 and to be discharged through the middle discharge ports 112.

Thus, while the wash water is rotated by the rotational movement of the pulsator 40, some of the water is guided along the main passageway 100*a* of the water guide 100 to the upper side of the washing tub 30 where the wash water finally flows out through the upper discharge port 111. Simultaneously, some of the wash water flowing in to the main passageway 100*a* of the water guide is guided through the branch passageway 120*a* to the auxiliary passageways 100*b*. The wash water flowing to the auxiliary passageways 100*b* is then guided to the middle discharge ports 112 by the guide protrusions 113, and flows out through the middle discharge ports 112 to the inner portion of the washing tub 30.

Additional description of the operation and effect thereof would be omitted, since it has been already described early.

As described above, according to the present invention, the water guide is formed with a plurality of middle discharge ports through which some of the wash water guided upward to the upper side of the washing tub flows out to the washing tub.

Accordingly, during the washing/rinsing process, the wash water flowing out through the middle discharge ports beats the clothes to be washed while pushing the clothes toward the center of the washing tub. As a result, the clothes are often beaten by the falling water stream discharged from the upper discharge port so that the washing efficiency is substantially enhanced.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A washing machine comprising:

a body;

a main tub installed in the body;

a washing and dehydrating tub installed in the main tub;

a pulsator installed at a bottom of the washing and dehydrating tub for forming a rotational water stream within the washing and dehydrating tub by being alternately rotated in opposite directions by means of a driving means; and at least one water guide provided on an inner peripheral surface of the washing and dehydrating tub, which forms a passageway extending vertically along the washing and dehydrating tub for diverting and upwardly guiding some of the wash water rotated by the pulsator and discharging that diverted wash water back into the washing and dehydrating tub, the water guide comprising:

a guide member installed on the inner peripheral surface of the washing and dehydrating tub for defining the passageway;

a duct member installed in the passageway on a rear surface of the guide member for dividing the passageway into a main passageway and a pair of auxiliary passageways;

an upper discharge port formed adjacent an upper end of the main passageway through which a part of the diverted wash water falls down into the washing and dehydrating tub; and middle discharge ports arranged along each of the auxiliary passageways and spaced from each other by a predetermined interval for discharging another part of the diverted wash water horizontally into the washing and dehydrating tub through a side thereof.

2. The washing machine as claimed in claim 1, wherein the upper discharge port has a hollow oblong shape, and the middle discharge ports comprise small holes.

3. The washing machine as claimed in claim 2, wherein the small holes are of various sizes.

4. The washing machine as claimed in claims 2 or 3, wherein a number and the positions of the small holes correspond to a wash water level of the washing and dehydrating tub.

5. A washing machine comprising:

a body;

a main tub installed in the body;

a washing and dehydrating tub installed in the main tub;

a pulsator installed at a bottom of the washing and dehydrating tub for forming a rotational water stream within the washing and dehydrating tub by being alternately rotated in opposite directions by means of a driving means; and at least one water guide provided on an inner peripheral surface of the washing and dehydrating tub, which forms a passageway extending vertically along the washing and dehydrating tub for diverting and upwardly guiding some of the wash water rotated by the pulsator and discharging that diverted wash water back into the washing and dehydrating tub, the water guide comprising:

a guide member installed on the inner peripheral surface of the washing and dehydrating tub for defining the passageway;

a duct member installed in the passageway on a rear surface of the guide member for dividing the passageway into a main passageway and a pair of auxiliary passageways, the duct member including an outwardly curved portion defining a water gathering area in the main passageway;

an upper discharge port formed adjacent an upper end of the main passageway through which a part of the diverted wash water falls down into the washing and dehydrating tub; and middle discharge ports disposed in the water gathering area for discharging another part of the diverted wash water horizontally into the washing and dehydrating tub through a side thereof.

6. The washing machine as claimed in claim 5, wherein the upper discharge port has a hollow oblong shape, while the middle discharge ports comprise small holes.

7. The washing machine as claimed in claim 6, wherein the small holes are arranged along edge areas of the water gathering portions in a pair of rows.

8. A washing machine comprising:

a body;

a main tub installed in the body;

a washing and dehydrating tub installed in the main tub;

a pulsator installed at a bottom of the washing and dehydrating tub for forming a rotational water stream within the washing and dehydrating tub by being alternately rotated in opposite directions by means of a driving means; and at least one water guide provided on an inner peripheral surface of the washing and dehydrating tub, which forms a passageway extending vertically along the washing and dehydrating tub for diverting and upwardly guiding some of the wash water rotated by the pulsator and discharging that diverted wash water back into the washing and dehydrating tub, the water guide comprising:

a guide member installed on an inner peripheral surface of the washing and dehydrating tub for defining the passageway;

a duct member installed in the passageway on a rear surface of the guide member for dividing the passageway into a main passageway and a pair of auxiliary passageways, the duct member including a wall structure separating the main passageway from the auxiliary passageways, the wall structure including openings located intermediate upper and lower ends of the duct member for conducting wash water from the main passageway to the auxiliary passageways, an upper discharge port formed adjacent an upper end of the main passageway through which a part of the diverted wash water falls down into the washing and dehydrating tub; and middle discharge ports arranged along each of the auxiliary passageways, and spaced from each other by a predetermined interval, for discharging another part of the diverted wash water horizontally into the washing and dehydrating tub through a side thereof.

9. The washing machine as claimed in claim 8, wherein each of the auxiliary passageways include a widened water gathering area for gathering wash water, each water gathering portion having some of the middle discharge port.

10. The washing machine as claimed in claim 9, wherein the upper discharge port has a hollow oblong shape, and the middle discharge ports comprise small holes.

11. The washing machine as claimed in claim 10, wherein the auxiliary passage are formed with guiding protrusions located adjacent respective ones of the small holes for guiding wash water into the small holes.

12. The washing machine as claimed in claim 11, wherein the guiding protrusions are formed above the respective small holes, and are of obliquely formed crescent shape, the guiding protrusions facing the small holes to guide the wash water into the respective small holes smoothly.

13. A washing machine comprising:

a body;

a main tub installed in the body;

a washing and dehydrating tub installed in the main tub;

a pulsator installed at a bottom of the washing and dehydrating tub for forming a rotational water stream within the washing and dehydrating tub by being alternately rotated in opposite directions by means of a driving means; and at least one water guide provided on an inner peripheral surface of the washing and dehydrating tub, which forms a passageway extending vertically along the washing and dehydrating tub for diverting and upwardly guiding some of the wash water rotated by the pulsator and discharging that diverted wash water back into the washing and dehydrating tub, the water guide comprising:

a guide member installed on an inner peripheral surface of the washing and dehydrating tub for defining the passageway;

a first duct member installed in the passageway on a rear surface of the guide member for defining a main passageway, and having openings formed therein intermediate upper and lower ends of the first duct member;

a second duct member encasing a lower portion of the first duct member including the openings of the first duct member, the second duct member forming auxiliary passageways communicating with the main passageway through the openings;

an upper discharge port formed adjacent an upper end of the main passageway through which a part of the diverted wash water falls down into the washing and dehydrating tub; and middle discharge ports arranged along each of the auxiliary passageways while spaced form each other by a predetermined interval, for discharging another part of the diverted wash water horizontally into the washing and dehydrating tub through a side thereof.

14. The washing machine as claimed in claim 13, wherein the upper discharge port has a hollow oblong shape, and the middle discharge ports comprise small holes.

15. The washing machine as claimed in claim 14, wherein the small holes are vertically arranged and spaced from each other by a predetermined interval in consideration of the wash water level of the washing and dehydrating tub.

16. A washing machine for forming a vertical stream of wash water falling to the inner portion of the washing and dehydrating tub from the upper side of the washing and dehydrating tub, and simultaneously for forming a horizontal stream of wash water flowing out from the side of the washing and dehydrating tub, comprising:

a body;

a main tub installed within the body;

a washing and dehydrating tub installed within the main tub;

a pulsator installed at a bottom of the washing and dehydrating tub, the pulsator forming a rotational water stream within the washing and dehydrating tub by being alternately rotated in opposite directions by means of a driving means;

a guide member installed at an inner peripheral surface of the washing and dehydrating tub and defining a passageway;

a duct member installed at a rear surface of the guide member for dividing the passageway into a main passageway and a pair of auxiliary passageways;

an upper discharge port formed adjacent an upper end of the main passageway through which a part of the wash water guided upwardly to the upper portion of the washing and dehydrating tub, falls down into the washing and dehydrating tub to form the vertical stream; and middle discharge ports arranged in predetermined intervals along each of the auxiliary passageways through which another part of the wash water, which is guided upwardly along the auxiliary passageways, flows out to the inner portion of the washing and dehydrating tub horizontally.

* * * * *